US008465375B2

(12) United States Patent
Curry

(10) Patent No.: US 8,465,375 B2
(45) Date of Patent: Jun. 18, 2013

(54) UNDERWATER DEVICE FOR GENERATING OR SHOOTING A VORTEX RING

(76) Inventor: Eric W. Curry, El Segundo, CA (US)

( * ) Notice: Subject to any disclaimer, the term of this patent is extended or adjusted under 35 U.S.C. 154(b) by 222 days.

(21) Appl. No.: 12/929,439

(22) Filed: Jan. 25, 2011

(65) Prior Publication Data

US 2012/0052964 A1 Mar. 1, 2012

Related U.S. Application Data

(60) Provisional application No. 61/376,867, filed on Aug. 25, 2010.

(51) Int. Cl.
*A63H 23/10* (2006.01)

(52) U.S. Cl.
USPC ..... 472/128

(58) Field of Classification Search
USPC ..... 472/128
See application file for complete search history.

(56) References Cited

U.S. PATENT DOCUMENTS

| | | | | | |
|---|---|---|---|---|---|
| 3,288,064 | A | * | 11/1966 | Gongwer | 102/322 |
| 3,372,873 | A | | 3/1968 | Weiss et al. | |
| 3,589,603 | A | * | 6/1971 | Fohl | 239/11 |
| 3,940,060 | A | | 2/1976 | Viets | |
| 4,534,914 | A | * | 8/1985 | Takahashi et al. | 261/64.3 |
| 5,042,819 | A | | 8/1991 | LaFata | |
| 5,052,813 | A | | 10/1991 | Latto | |
| 5,100,242 | A | * | 3/1992 | Latto | 366/267 |
| D331,609 | S | | 12/1992 | LaFata | |
| 5,865,438 | A | | 2/1999 | Zilliox | |
| 5,947,784 | A | * | 9/1999 | Cullen | 446/15 |
| 6,007,237 | A | | 12/1999 | Latto | |
| D427,600 | S | | 7/2000 | Pröbstel et al. | |
| 6,488,270 | B2 | * | 12/2002 | Whiteis | 261/62 |
| 6,736,375 | B2 | * | 5/2004 | Whiteis | 261/64.1 |
| 6,824,125 | B2 | * | 11/2004 | Thomas | 261/64.3 |
| 6,953,376 | B1 | | 10/2005 | Kim et al. | |
| D521,574 | S | | 5/2006 | McBride et al. | |
| 7,059,544 | B2 | | 6/2006 | Leonard et al. | |
| 7,191,774 | B2 | | 3/2007 | Thorne | |
| D548,290 | S | | 8/2007 | Chuang et al. | |
| 7,300,040 | B2 | * | 11/2007 | Thomas | 261/79.2 |
| 7,673,834 | B2 | | 3/2010 | Harman | |
| 7,731,064 | B2 | | 6/2010 | Chuang et al. | |
| 2004/0088894 | A1 | | 5/2004 | Haughton et al. | |
| 2004/0217490 | A1 | | 11/2004 | Whiteis | |
| 2006/0214316 | A1 | | 9/2006 | Whiteis | |
| 2007/0200260 | A1 | | 8/2007 | Whiteis | |
| 2010/0015879 | A1 | | 1/2010 | Davis | |
| 2010/0184523 | A1 | | 7/2010 | Davis | |
| 2012/0052965 | A1 | * | 3/2012 | Curry | 472/128 |

OTHER PUBLICATIONS

U.S. Appl. No. 29/371,380, filed Jan. 25, 2011, entitled "Underwater Vortex Ring Shooter".
U.S. Appl. No. 13/067,017, filed May 3, 2011, entitled "Self-Priming Underwater Device for Generating or Shooting a Vortex Ring".
Office Action dated Aug. 14, 2012, in U.S. Appl. No. 29/371,380, filed Jan. 25, 2011.

* cited by examiner

*Primary Examiner* — Kurt Fernstrom
*Assistant Examiner* — Dolores Collins
(74) *Attorney, Agent, or Firm* — Dinesh Agarwal, P.C.

(57) ABSTRACT

An underwater device for generating a vortex ring includes a liquid chamber, and a fluid or air chamber contiguous to the liquid chamber and separated by a partition wall. The liquid chamber includes a generally rigid section and a compressible or flexible section. The rigid section includes an opening for selectively loading the liquid chamber with a liquid and for discharging a vortex ring therefrom.

32 Claims, 5 Drawing Sheets

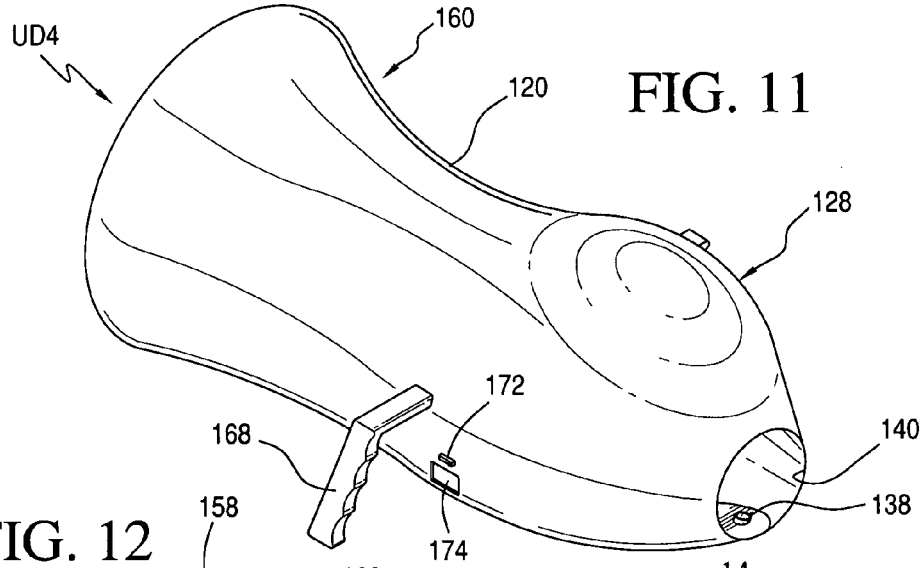
FIG. 11
FIG. 12
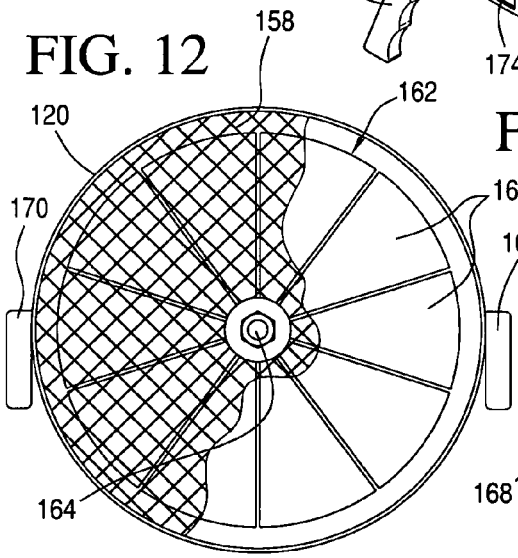
FIG. 13
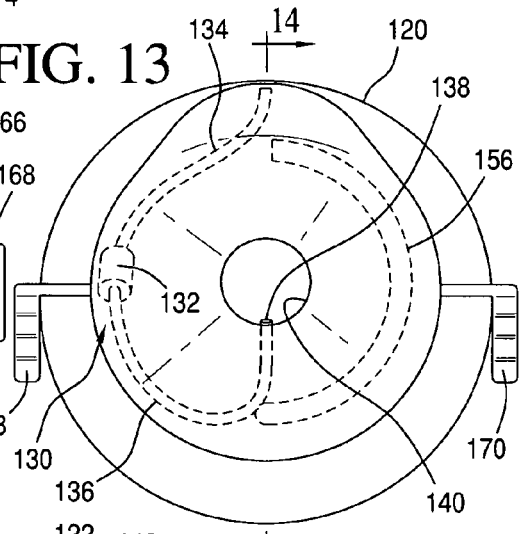
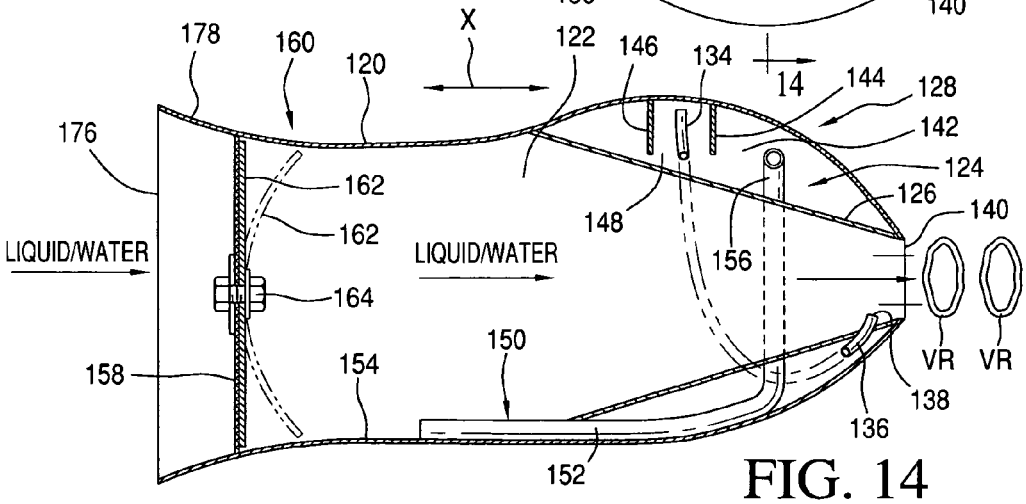
FIG. 14

UNDERWATER DEVICE FOR GENERATING OR SHOOTING A VORTEX RING

CROSS-REFERENCE TO RELATED APPLICATIONS

The present application claims the benefit of prior U.S. Provisional Application Ser. No. 61/376,867, filed Aug. 25, 2010, which is hereby incorporated herein in its entirety by reference.

FIELD AND BACKGROUND OF THE INVENTION

The present invention is generally directed to a toy or amusement device, and more particularly to an underwater device for generating or shooting a vortex ring.

It is entertaining to generate or watch a bubble ring being generated, whether in air or in a liquid medium, such as water. Both the children and adults are known to engage in such an activity. For instance, children learn to make soap bubbles at an early age. Likewise, the adults are often seen to amuse others and themselves by generating smoke rings when smoking a cigarette, pipe, or cigar. Watching the rings or bubbles rise up in the air or through a liquid, is not only uplifting, but also aesthetically very pleasing.

Various devices for generating bubbles and rings are available in the prior art, as shown in U.S. Pat./Publications Nos. 3,372,873; 3,589,603; 4,534,914; 5,042,819; 5,052,813; 5,947,784; 6,007,237; 6,488,270; 6,736,375; 6,824,125; 7,300,040; 2004/0088894; 2004/0217490; 2006/0214316; 2007/0200260; 2010/0015879; and 2010/0184523.

ASPECTS OF THE INVENTION

The present disclosure is directed to various aspects of the present invention.

One aspect of the present invention includes an underwater device for generating or shooting a vortex ring.

Another aspect of the present invention includes an underwater device for generating or shooting a vortex ring of a liquid, such as water, and a fluid, such as air. In particular, the device generates a vortex ring that is entrained with air.

Another aspect of the present invention includes an underwater device for generating or shooting a vortex ring that is hand-held.

Another aspect of the present invention includes an underwater device for generating or shooting a vortex ring that is manually-powered.

Another aspect of the present invention includes an underwater device for generating or shooting a vortex ring that is self-contained in that it includes a supply of unpressurized fluid or air.

Another aspect of the present invention includes an underwater device for generating or shooting a vortex ring that has a volume capacity to produce multiple consecutive vortex rings before reloading. In particular, the device is configured to fire repeatedly to produce five to fifty vortex rings with one full chamber of air.

Another aspect of the present invention includes an underwater device for generating or shooting a vortex ring, wherein the air for rings is ejected by the same force of water being ejected substantially simultaneously.

Another aspect of the present invention includes an underwater device for generating or shooting a vortex ring that is simple in design and whose function is not adversely impacted by jostling, shaking, or playful manhandling, etc.

Another aspect of the present invention includes an underwater device that can shoot a vortex ring to a distance of about 5-25 feet in the water.

Another aspect of the present invention includes an underwater device for generating or shooting a vortex ring, wherein the vortex ring can be pointed and/or directed at a target at will. The device can, therefore, be used to engage in underwater games that are fun, playful, and/or competitive.

Another aspect of the present invention includes an underwater device for generating a vortex ring, including a liquid chamber, and a fluid chamber contiguous to the liquid chamber and separated by a partition wall. The liquid chamber includes a generally rigid section and a compressible section. The rigid section includes an opening for selectively loading the liquid chamber with a liquid and for discharging a vortex ring therefrom.

Another aspect of the present invention includes a hand-held underwater device for generating a liquid vortex ring, including a liquid chamber, and an air chamber contiguous to the liquid chamber and separated by a partition wall. The liquid chamber includes a generally rigid section and a compressible section. The rigid section includes an opening for selectively loading the liquid chamber with a liquid and for discharging a vortex ring therefrom. A conduit supplies air from the air chamber to an area adjacent the opening to be entrained in the vortex ring.

Another aspect of the present invention includes a self-contained underwater amusement device for shooting a liquid vortex ring, including a liquid chamber, and an air chamber contiguous to the liquid chamber and separated by a partition wall. The liquid chamber includes a liquid accelerator section and a compressible section. The accelerator section includes an opening for loading the liquid chamber with a liquid. A conduit supplies air from the air chamber to an area adjacent the opening to be entrained in the vortex ring. A plurality of actuators move the compressible section for creating an internal pressure to shoot the vortex ring from the opening.

Another aspect of the present invention includes an underwater device for generating a vortex ring, including a liquid chamber, and a fluid chamber contiguous to the liquid chamber and separated by a partition wall. A liquid propulsion member is positioned within the liquid chamber, and an opening selectively loads the liquid chamber with a liquid and discharges a vortex ring therefrom.

BRIEF DESCRIPTION OF THE DRAWINGS

One of the above and other aspects, novel features and advantages of the present invention will become apparent from the following detailed description of a preferred embodiment(s) of the invention, as illustrated in the drawings, in which:

FIG. 11 is a fourth preferred embodiment of the device of the present invention;

FIG. 12 is a rear elevational view of the device shown in FIG. 11;

FIG. 13 is a front elevational view of the device shown in FIG. 11; and

FIG. 14 is a vertical cross-sectional view taken along line 14-14 of FIG. 13.

DETAILED DESCRIPTION OF THE PREFERRED EMBODIMENT(S) OF THE INVENTION

Figure 1:
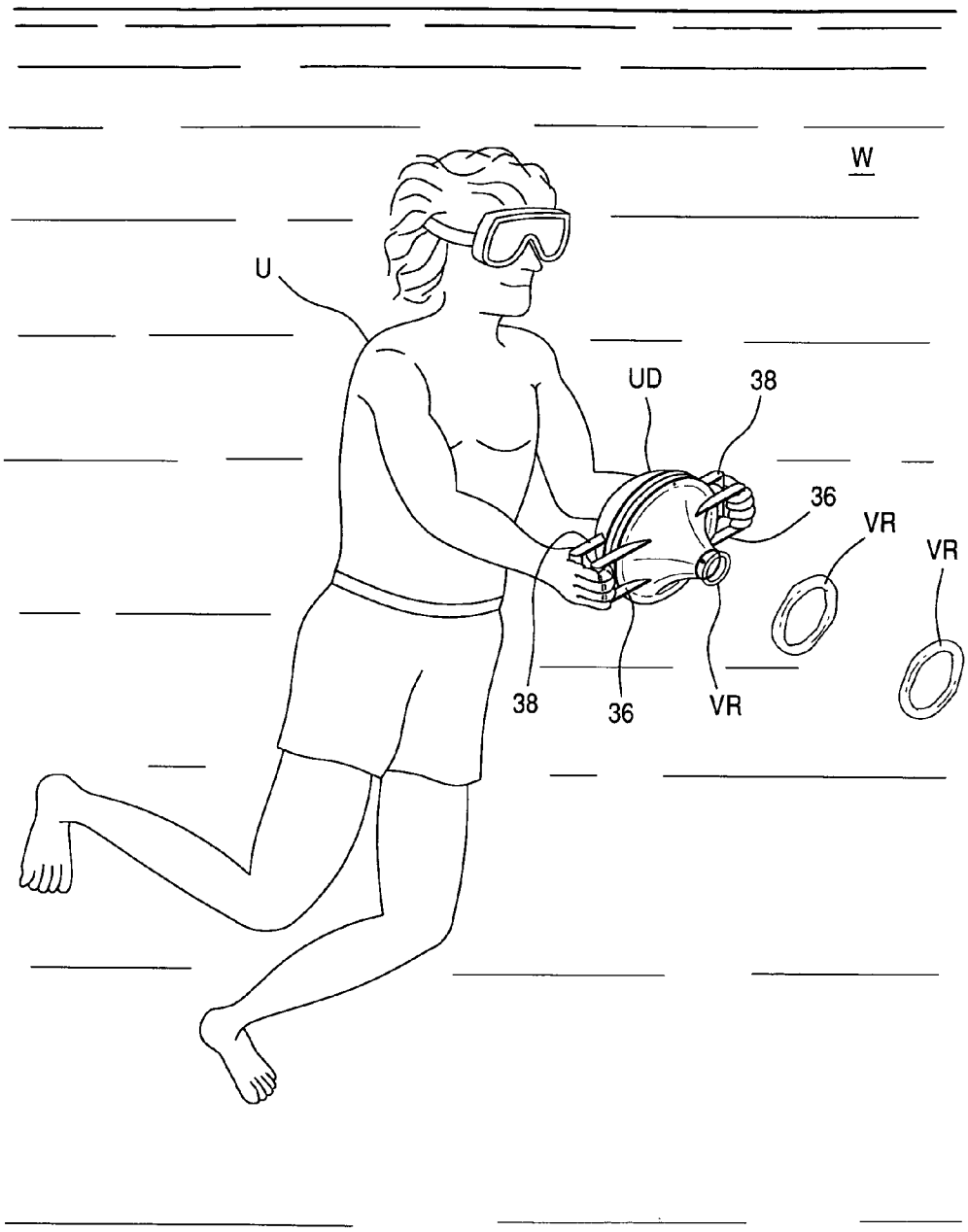
FIG. 1 illustrates a first preferred embodiment of the device of the present invention, shown in use.

As best shown in FIGS. 1-4, the underwater device UD, in accordance with a first embodiment of present invention, includes front and rear shells 10 and 12, respectively, connected by a middle compressible section 14. A partition wall 16 separates the rear shell 12, from the front shell 10 and the middle compressible section 14, which together form a liquid chamber 18 to hold a liquid, such as water W. The rear shell 12 includes a fluid chamber 20 for supplying, for example, low-pressure air to be entrained in the vortex rings VR, as described below in more detail.

Preferably, the front shell 10 is generally cone- or funnel-shaped, and the rear shell 12 is concave or dome-shaped. Both the front and rear shells 10 and 12 are, preferably, made of a clear or colored plastic, or the like rigid material. Alternatively, the front and rear shells 10 and 12 may be made of metal, or other solid or translucent material.

A fluid-supply assembly 22 includes a one-way check valve 24, mounted preferably centrally on the partition wall 16, an inlet tube 26, and an outlet tube 28. The fluid (or air) from the fluid chamber 20 passes through the check valve 24 and exits the outlet tube 28 at the opening 30 thereof, which is strategically positioned adjacent a front opening 32 of the underwater device UD. The front opening 32 is used to shoot vortex rings VR therefrom, as well as to initially fill (or load) the chamber 18 with the liquid.

Figure 3:
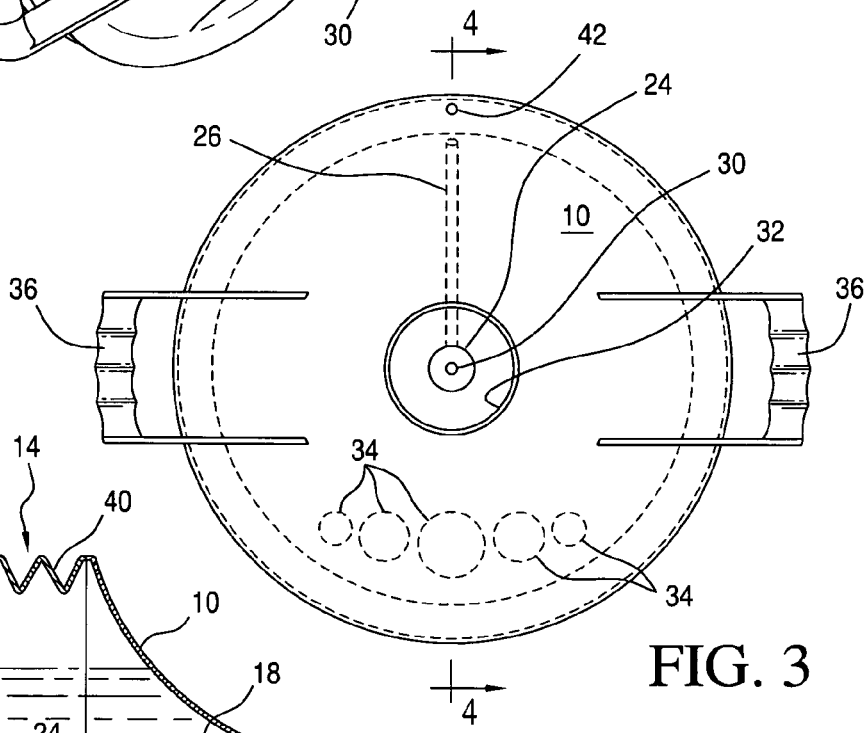
FIG. 3 is a front elevational view of the device shown in FIG. 2.
Figure 4:
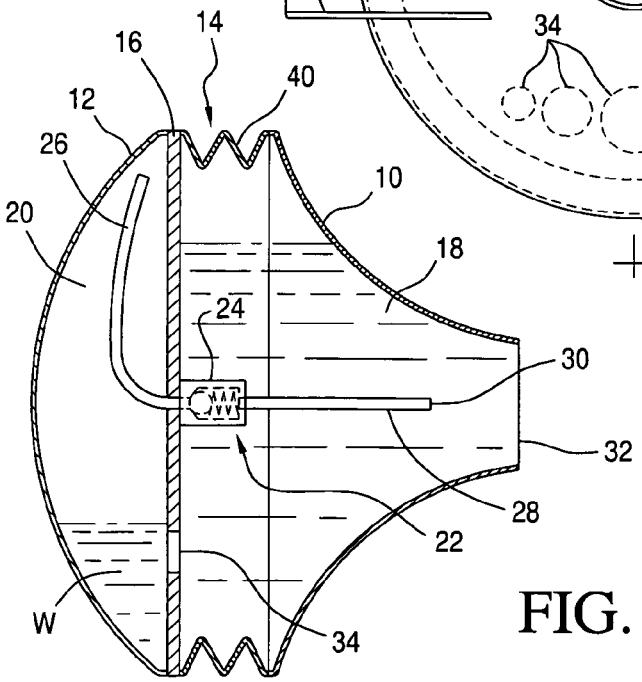
FIG. 4 is a vertical cross-sectional view taken along line 4-4 of FIG. 3.

As best shown in FIG. 3, preferably five holes 34 of varying diameters are provided in the partition wall 16, so as to allow the liquid chamber 18 to be in fluid communication with the fluid chamber 20. It is noted herewith that the number, diameter, shape, configuration, arrangement, etc., of the holes 34 may be varied, as desired, to alter the functionality and/or efficiency of the underwater device UD.

The underwater device UD further includes front and rear handles 36 and 38, preferably mounted on each of the left and right sides of the front and rear shells 10 and 12, respectively. The handles 36 and 38 can be integrally molded with the respective shells 10 and 12, or made separately. It will be appreciated that the front and rear handles 36 and 38 can be squeezed, jerked, or snapped together quickly by a user U (FIG. 1), to allow a swift relative movement between the front and rear shells 10 and 12, via the middle compressible section 14. In this regard, it is noted herewith that although the compressible section 14 is preferably configured as a bellows 40, other forms or construction may be used. For example, the compressible section 14 can be a flexible or pliable membrane, a resilient diaphragm, or the like structure.

The preferred shape of the front shell 10 enhances or maximizes the force of liquid, such as water, to be discharged through the front opening 32 of the underwater device UD, as a toroid, even when a small force is utilized to squeeze the front and rear handles 36 and 38. In other words, the front shell 10 functions as an accelerator for the water, when the underwater device UD is actuated or fired.

Figure 2:
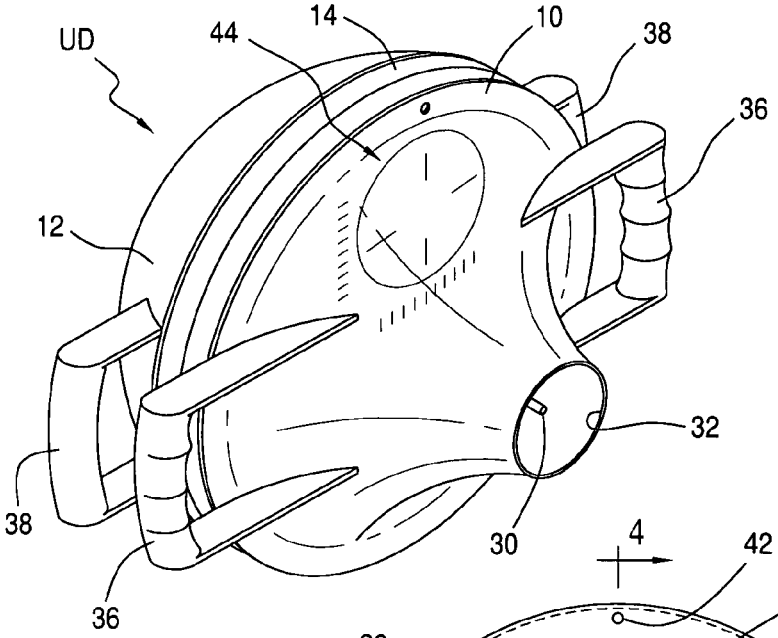
FIG. 2 is a perspective view of the first preferred embodiment of the device of the present invention.

As best shown in FIGS. 2-3, a vent hole 42 is provided near the top of the front shell 10 to allow the air to escape from the liquid chamber 18. In order to enhance the aiming aspect or appeal of the underwater device UD, a suitable graphic 44, preferably simulating a scope reticle, is provided on the front on the shell 10. The graphic 44 may be imprinted, stenciled, or applied on a sticker or the like clear label.

Although variable, it is preferred that the liquid and fluid chambers 18 and 20, occupy about three-fourth and one-fourth of the overall volume of the underwater device UD, respectively.

Figure 5:
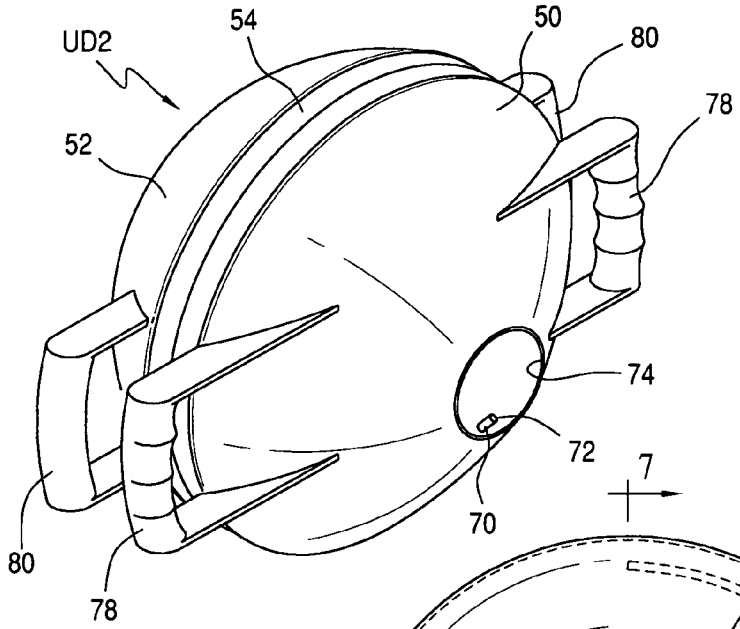
FIG. 5 is a perspective view of a second preferred embodiment of the device of the present invention.
Figure 6:
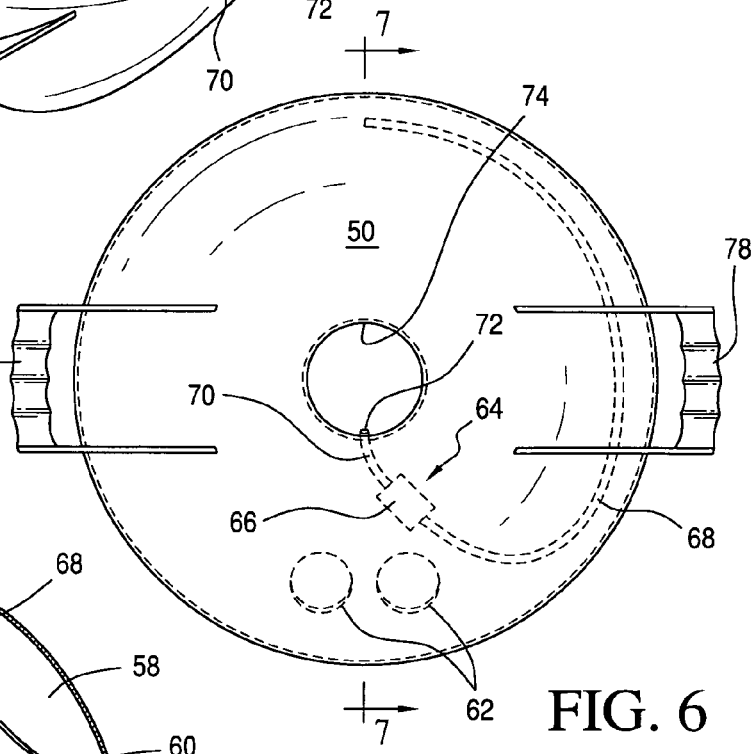
FIG. 6 is a front elevational view of the device shown in FIG. 5.
Figure 7:
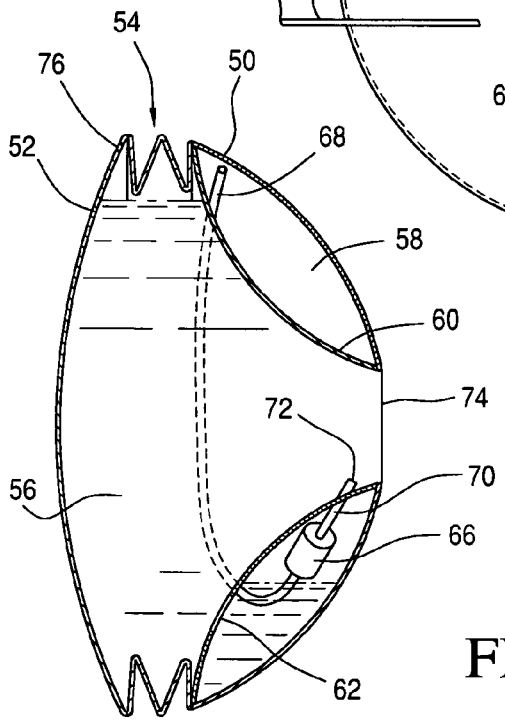
FIG. 7 is a vertical cross-sectional view taken along line 7-7 of FIG. 6.

Referring to FIGS. 5-7, a second preferred embodiment of the underwater device UD2 will now be described. As shown, the underwater device UD2 includes generally concave or dome-shaped front and rear shells 50 and 52, respectively, connected by a middle compressible section 54. The compressible section 54 is similar in design and construction to the middle compressible section 14, described above in connection with the first preferred embodiment. Likewise, the front and rear shells 50 and 52 are made of clear, translucent, or solid plastic or the like rigid material, which may be colored.

The rear shell 52 and the middle compressible section 54, together form a liquid chamber 56 for holding, for example, water W. As best shown in FIG. 7, the front shell 50 includes a generally circular or ring-shaped recess 58, which functions as a fluid or air chamber and is separated from the liquid chamber 56 by a partition wall 60. Preferably, two holes 62 in the partition wall 60 keep the chambers 56 and 58 in a fluid communication. It is noted herewith that it is within the scope of the present invention to vary the size, shape, and/or the number and arrangement of the holes 62, as desired, to vary the functionality and/or efficiency of the underwater device UD2.

A fluid-supply assembly 64 includes a one-way check valve 66, an inlet tube 68, and an outlet tube 70. The outlet tube opening 72 is positioned adjacent the front opening 74 of the underwater device UD2, to supply a fluid, such as air, to be entrained in the vortex ring or slug of water exiting therethrough. The inlet tube 68 runs along the outer periphery of the front shell 50 and terminates in the fluid chamber 58. Although not shown, clips or other suitable mechanical fasteners, or adhesive, may be used to secure the fluid-supply assembly 64 in place.

As in the first preferred embodiment UD, a hole 76 is provided but in the rear shell 52 to allow the air to vent from the liquid chamber 56. Likewise, left and right sets of front and rear handles 78 and 80, are provided on each side of the front and rear shells 50 and 52, respectively, to allow the user U to move or squeeze the shells 50 and 52, to operate or fire the underwater device UD2.

Figure 8:
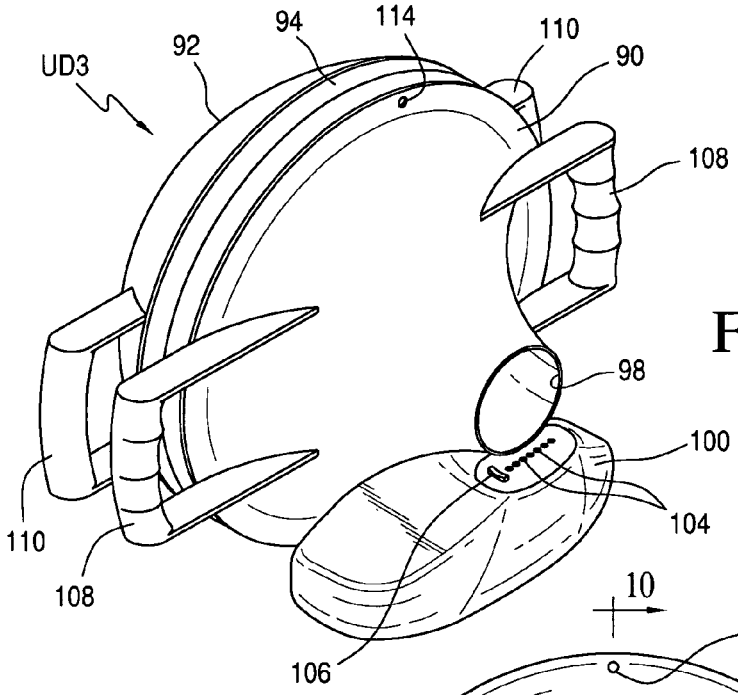
FIG. 8 is a perspective view of a third preferred embodiment of the device of the present invention.
Figure 9:
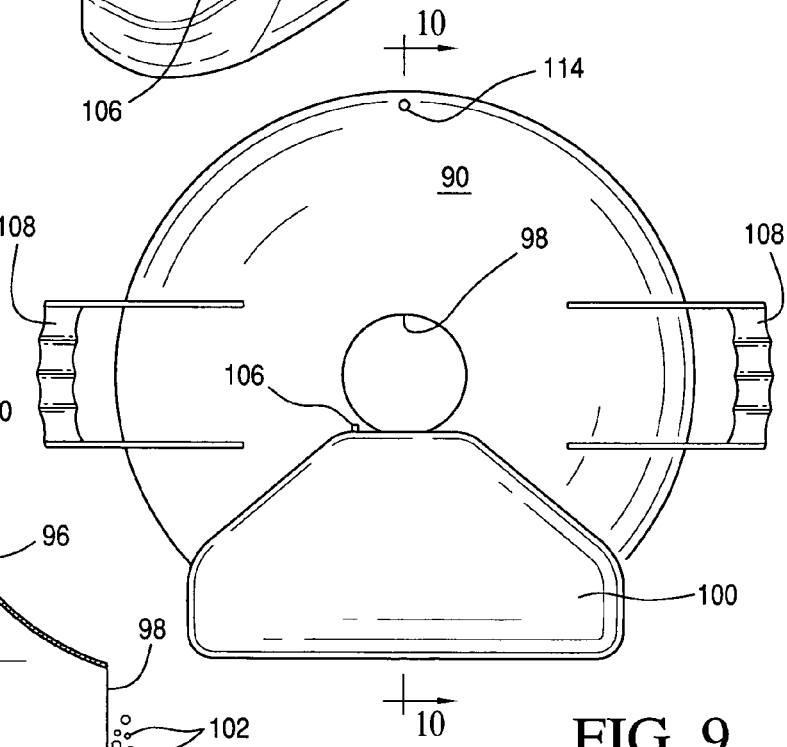
FIG. 9 is front elevational view of the device shown in FIG. 8.
Figure 10:
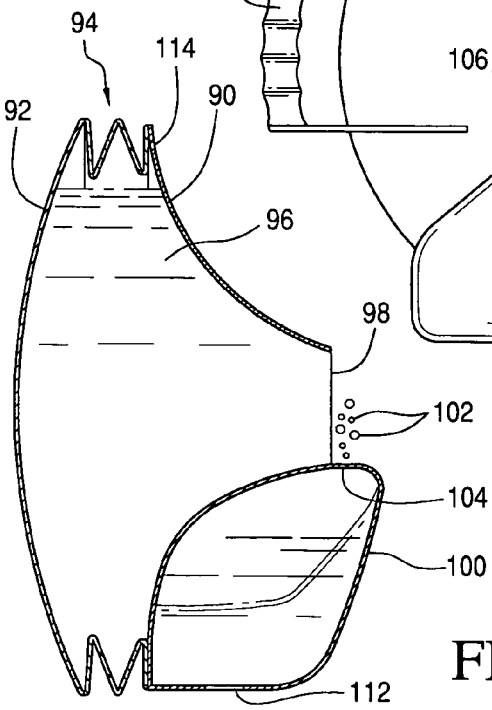
FIG. 10 is a vertical cross-sectional view taken along line 10-10 of FIG. 9.

Referring to FIGS. 8-10, a third preferred embodiment of the underwater device UD3 will now be described. As shown, the underwater device UD3 preferably includes a cone-shaped front shell 90 and a generally concave rear shell 92. The front and rear shells 90 and 92 are connected by a middle compressible section 94, which is similar in design and construction to the above-described compressible sections 14 and 54. Likewise, the front and rear shells 90 and 92 are made of clear, translucent, or solid plastic or the like rigid material, which may be colored.

The front and rear shells 90 and 92, and the middle compressible section 94, together define a liquid chamber 96 for holding a liquid, such as water W. The front shell 90 includes a front opening 98 which is used to fill the chamber 96 with the liquid, as well as to shoot vortex rings VR therefrom.

The third embodiment of the underwater device (UD3) is different from the embodiments described above in that an external housing 100 serves as a fluid chamber for supplying a fluid, such as air, in the form of bubbles 102 in front of the front opening 98, via a series of tiny holes 104. A suitable slider 106 is provided to selectively cover one or more of the holes 104, to vary the amount or location of the exiting series of the bubbles 102. As in the previous embodiments, left and right sets of front and rear handles 108 and 110, are mounted on the front and rear shells 90 and 92, respectively. The underwater device UD3 is particularly suitable for users who are unable to, or do not desire to, squeeze the handles 108 and 110 too hard to shoot vortex rings VR through the front opening 98.

As best shown in FIG. 10, a bottom opening 112 allows for draining of any liquid that gets collected inside the housing 100, during use. As in the previous embodiments, a hole 114 in the front shell 90 allows the air to vent from the liquid chamber 96.

Referring to FIGS. 11-14, a fourth preferred embodiment of the underwater device UD4 will now be described. As shown, the underwater device UD4 preferably includes a hollow housing 120 of a generally rigid material. The housing 120 is preferably elongated and follows the general configuration of a fish in cross-section to render aerodynamic properties (FIG. 14). It is noted herewith that it is within the scope of the present invention to utilize other shapes or configurations, as desired.

The interior of the housing 120 includes a liquid chamber 122 and a fluid chamber 124, separated by a partition wall 126, which is preferably cone-shaped. As best shown in FIG. 14, the fluid chamber 124 is preferably circular in configuration and is positioned in the front, hump section 128 of the housing 120.

A fluid-supply assembly 130 is positioned in the hump section 128 and includes a one-way check valve 132, an inlet tube 134, and an outlet tube 136. The outlet tube opening 138 is positioned adjacent the front opening 140 of the underwater device UD4. The inlet tube 134 terminates in an upper section 142 of the fluid chamber 124, where the front and rear baffles 144 and 146 provide an air-dam zone 148 for the inlet tube 134. The air-dam zone 148 prevents the liquid from entering the inlet tube 134.

As best shown in FIG. 14, an L-shaped compression hose 150 propels a portion of the liquid from the liquid chamber 122 into the fluid chamber 124. The compression hose 150 includes a lower section 152 extending along the bottom 154 of the housing 120, and an upper section 156, which extends along the interior periphery of the hump section 128 and terminates in the fluid chamber 124. The liquid carried by the hose 150, creates a compression force or pressure in the fluid chamber 124 to push the fluid into the inlet tube 134.

As best shown in FIGS. 12 and 14, a preferably rigid mesh or grill 158 is positioned in the rear section 160 of the housing 120. A diaphragm 162 is fastened on the inside of the mesh 158 by suitable mechanical fasteners 164. The diaphragm 162 is preferably made of a flexible or bendable material and is slit radially to provide multiple blades 166, in a fan-like configuration.

Left and right handles 168 and 170 are provided to allow a user to grasp the underwater device UD4 for use. As best shown in FIG. 11, a slider switch 172 is positioned adjacent the left handle 168 to allow a user to open a door 174 for draining the water from inside the fluid chamber 124.

In underwater device UD4, the liquid or water enters the housing 120 through the rear opening 176, and exits via the front opening 140 in the form of vortex rings VR, when a user jerks or shakes the device UD4 back and forth in an underwater environment (arrow X in FIG. 14).

As best shown in FIG. 14, a generally flared tail section 178 directs more water into the housing 120 via the rear opening 176, the flow of which accelerates by the Venturi effect created by the funnel or conical shape of the partition wall 126.

In the various embodiments of the underwater device illustrated herein, the ratio of the diameter of the front opening (32, 74, and 98) to the overall diameter of the device, is 0.6-1.6 to 4, preferably 0.8-1.2 to 4, and more preferably 1 to 4. In this regard, it is noted herewith that although the embodiments are illustrated with a single, circular front opening, it is within the scope of the invention to vary the shape and number thereof for enhancing the performance, efficiency, and/or functionality of the device. For instance, it may be desirable to shoot more than one vortex rings simultaneously, and of different sizes. Therefore, an embodiment of the underwater device can be devised, where more than one front opening, of different shapes and/or sizes shapes, is provided. It is also within the scope of the present invention to provide a suitable mechanism for generating a sound, or some sort of audio signal, when the front and rear handles are actuated or snapped together to fire the device. For example, an audible mechanism can be incorporated in the device of the present invention to generate a crunching or a high-pitch squeak, or the like sound when the device generates vortex rings. It is further within the scope of the invention to add a suitable mechanism that generates a visual indicator or illumination, which signals the firing of the device, and/or simply highlights the vortex rings or their paths of travel through the water.

In order to shoot multiple vortex rings VR, without reloading of the underwater device of the present invention, it is preferred that the volume of the liquid chamber be about three times of the fluid chamber. This construction would produce about five to fifty vortex rings with one full chamber of air. It is noted herewith that the volumes of the liquid and fluid chambers may be varied to increase or decrease the number of vortex rings to be shot without the need for reloading of the device with water and fluid.

USE AND OPERATION

Referring to FIGS. 1-4, a preferred manner of using the underwater device UD of the present invention will now be described. A user U simply holds the underwater device UD, by grasping the left and right sets of front and rear handles 36 and 38, and submerges it in the water W. (One would appreciate that the fluid chamber of the device would be full of air before the device is brought under the water.) Once submerged, the user U simply holds the device UD until the liquid chamber gets filled up the water W entering through the front opening 32. At this point, the device UD is primed or fully loaded. In order to shoot a vortex ring VR, the user U simply jerks or snaps the front and rear handles 36 and 38 together. This swift action propels a toroid or slug of spinning water out of the front opening 32. Substantially simultaneously with this action, a portion of the water W is displaced into the rear, low pressure fluid chamber 20, through the holes 34 in the partition wall 16. This displacement of water causes a brief high pressure to build up in the rear fluid chamber 20, because of the swift motion between the front and rear shells 10 and 12. The increased pressure in the fluid chamber 20 forces the air therein to enter the inlet tube 26 and pass through the check valve 24, by overcoming the pressure therein, and shoot a small burst of air through the front opening 30, via the outlet tube 28. This tiny burst of air gets entrained in the vortex ring VR being formed substantially simultaneously therewith. Therefore, as the slug of water shoots out from the front opening 32, the burst of air from the outlet tube opening 30, forms a bubble ring in the low-pressure region of the vortex or toroid of spinning water.

The vortex rings VR formed by the underwater device UD of the present invention, are estimated to travel 12-16 feet through the water and bounce off the water surface when the underwater device UD is pointed towards the top. As also noted above, the unique design and construction of the underwater device UD allows for generating or shooting five to fifty vortex rings with one full chamber of air. In other words, once the underwater device UD is fully primed and loaded, multiple consecutive vortex rings can be shot one after another without having the need to bring the device out of the water to reload with air.

The second preferred embodiment of the underwater device UD2 operates in the same manner. The third embodiment of the underwater device UD3 also operates in a similar fashion, except that since the air in the external housing 100 automatically escapes in the form of bubbles through the tiny holes 104, the force with which the front and rear handles are needed to be snapped or to be squeezed, is relatively low, compared to the force needed in the first and second embodiments UD and UD2. As a result, this embodiment (UD3) is believed to be particularly suited for very young children, or those users who are unable to squeeze the front and rear handles hard.

As to the use and operation of the fourth preferred embodiment, the underwater device UD4 is primed or loaded in the same manner as the other embodiments discussed above. Once loaded with air and water, the device UD4 is simply jerked or thrust back and forth to force the water out through the front opening 140, as spinning slugs or toroids. During this movement, a portion of the water is displaced into the fluid chamber 124, via the compression hose 150 building a pressure therein, which forces a burst of air through the outlet tube opening 138, from the inlet tube 134 to the check valve 132 and through the outlet tube 136. This burst of air gets entrained in the water slugs being formed substantially simultaneously adjacent the front opening 140. In order to shoot or fire consecutive vortex rings, the user U merely need to keep thrusting the device UD4 back and forth, as shown by arrow X in FIG. 14.

While this invention has been described as having preferred sequences, ranges, steps, materials, structures, shapes, configurations, features, components, or designs, it is understood that it is capable of further modifications, uses and/or adaptations of the invention following in general the principle of the invention, and including such departures from the present disclosure as those come within the known or customary practice in the art to which the invention pertains, and as may be applied to the central features hereinbefore set forth, and fall within the scope of the invention and of the limits of the appended claims.

What is claimed is:

1. A manually-powered underwater device for generating a vortex ring, comprising:
a) a liquid chamber;
b) a fluid chamber contiguous to said liquid chamber and separated by a partition wall;
c) said liquid chamber comprising a generally rigid section and a compressible section; and
d) said rigid section including an opening for selectively loading said liquid chamber with a liquid and for discharging a vortex ring from the same opening.

2. The device of claim 1, wherein:
a) said fluid chamber supplies a fluid adjacent said opening to be entrained in the vortex ring.

3. The device of claim 2, wherein:
a) said liquid and fluid chambers comprise volume capacities to produce a plurality of consecutive vortex rings before reloading.

4. The device of claim 3, wherein:
a) said compressible section comprises a resilient diaphragm or bellows.

5. The device of claim 1, wherein:
a) said compressible section is movable relative to said rigid section to thereby create an internal pressure to force a slug of liquid out from said opening.

6. The device of claim 5, further comprising:
a) an actuator for manually moving said compressible section relative to said rigid section.

7. The device of claim 5, wherein:
a) said rigid section comprises a front shell attached to one side of said compressible section.

8. The device of claim 7, further comprising:
a) a rear shell attached to said compressible section at another side generally opposed to said one side thereof.

9. The device of claim 8, wherein:
a) said front shell comprises a generally cone-shaped member; and
b) said rear shell comprises a generally dome-shaped member.

10. The device of claim 7, wherein:
a) said fluid chamber comprises an air chamber located in said rear shell.

11. The device of claim 10, wherein:
a) said liquid and air chambers are in fluid communication with each other via a port in said partition wall.

12. The device of claim 11, further comprising:
a) a tubular member including a first end portion in fluid communication with said air chamber and a second end portion lying adjacent said opening.

13. The device of claim 12, further comprising:
a) a one-way valve operably connected to said tubular member.

14. The device of claim 7, wherein:
a) said fluid chamber comprises an air chamber located in said front shell.

15. The device of claim 14, wherein:
a) said air chamber comprises a generally ring-shaped recess in fluid communication with said liquid chamber via a port in said partition wall.

16. The device of claim 7, wherein:
a) said fluid chamber comprises an air chamber located externally of the device adjacent said opening.

17. A manually-powered underwater device for generating a liquid vortex ring, comprising:
a) a liquid chamber;
b) an air chamber contiguous to said liquid chamber and separated by a partition wall;
c) said liquid chamber comprising a generally rigid section and a compressible section;
d) said rigid section including an opening for selectively loading said liquid chamber with a liquid and for discharging a vortex ring from the same opening; and
e) a conduit for supplying air from said air chamber to an area adjacent said opening to be entrained in the vortex ring.

18. The device of claim 17, wherein:

a) said compressible section comprises a resilient diaphragm or bellows for creating an internal pressure to force a slug of liquid out from said opening.

19. The device of claim 18, wherein:

a) said rigid section comprises a generally cone-shaped member attached to one end of said diaphragm or bellows; and b) a shell member attached to an opposite end of said diaphragm or bellows.

20. The device of claim 18, wherein:

a) said rigid section comprises a generally dome-shaped shell member; and b) said air chamber is located in said shell member.

21. The device of claim 19, wherein:

a) said air chamber is located in said shell member.

22. The device of claim 19, wherein:

a) said air chamber is located externally of the device adjacent said opening.

23. A manually-powered underwater device for generating a vortex ring, comprising:

a) a liquid chamber;

b) a fluid chamber contiguous to said liquid chamber and separated by a partition wall;

c) a liquid propulsion member positioned within said liquid chamber; and d) an opening for selectively loading said liquid chamber with a liquid and for discharging a vortex ring from the same opening.

24. The device of claim 23, wherein:

a) said fluid chamber supplies a fluid adjacent said opening to be entrained in the vortex ring.

25. The device of claim 24, wherein:

a) said liquid propulsion member comprises a flexible diaphragm.

26. The device of claim 24, wherein:

a) said liquid and fluid chambers comprise volume capacities to produce a plurality of consecutive vortex rings before reloading.

27. The device of claim 23, wherein:

a) said liquid and fluid chambers are in fluid communication with each other via a conduit.

28. The device of claim 23, wherein:

a) the device includes front and rear sections; and b) said fluid chamber is located in said front section.

29. The device of claim 28, wherein:

a) said liquid chamber includes a generally cone-shaped section located in said front section.

30. The device of claim 29, wherein:

a) said liquid propulsion member is located in said rear section.

31. The device of claim 23, wherein:

a) the device is self-contained.

32. A manually-powered underwater device for generating a vortex ring, comprising:

a) a liquid chamber;

b) a fluid chamber contiguous to said liquid chamber and separated by a partition wall;

c) said liquid chamber comprising a generally rigid section and a compressible section; and d) said rigid section including a single opening for selectively loading said liquid chamber with a liquid and for discharging a vortex ring therefrom.

* * * * *